US005794373A

United States Patent [19]

Moon

[11] Patent Number: 5,794,373

[45] Date of Patent: Aug. 18, 1998

[54] CARTRIDGE EXTRACTOR

[76] Inventor: Kook-Jin Moon, 630 Rte. 303, Blauvelt, N.Y. 10913

[21] Appl. No.: 854,833

[22] Filed: May 12, 1997

Related U.S. Application Data

[63] Continuation-in-part of Ser. No. 536,009, Sep. 29, 1995, Pat. No. 5,678,340.

[51] Int. Cl.[6] ..... F41A 15/00

[52] U.S. Cl. ..... 42/25

[58] Field of Search ..... 42/25

[56] References Cited

U.S. PATENT DOCUMENTS

| | | | |
|---|---|---|---|
| 1,039,337 | 9/1912 | Vanderbeek | 269/165 |
| 2,479,844 | 8/1949 | Koucky et al. | 42/25 |
| 2,929,163 | 3/1960 | Harvey | 42/25 |
| 3,142,923 | 8/1964 | Vartanian | 42/25 |
| 3,696,542 | 10/1972 | Ekfeldt et al. | 42/16 |
| 4,061,075 | 12/1977 | Smith | 89/132 |
| 4,253,377 | 3/1981 | Arnett | 89/163 |
| 4,265,043 | 5/1981 | Rowlands | 42/25 |
| 4,272,902 | 6/1981 | Waters | 42/25 |
| 4,402,152 | 9/1983 | Casull | 42/16 |
| 4,615,132 | 10/1986 | Smith | 42/25 |
| 5,024,016 | 6/1991 | Smith | 42/25 |
| 5,129,172 | 7/1992 | Brennan | 42/25 |
| 5,133,142 | 7/1992 | Peters | 42/25 |
| 5,678,340 | 10/1997 | Moon | 42/25 |

FOREIGN PATENT DOCUMENTS 1448 7/1898 Denmark .

*Primary Examiner*—Charles T. Jordan
*Assistant Examiner*—Meena Chelliah
*Attorney, Agent, or Firm*—Alix, Yale & Ristas

[57] ABSTRACT

A firearm having a frame and a slide supported for movement on the frame between battery and retired positions. The slide has an ejection port and a slot longitudinally extending from the ejection port for supporting a cartridge extractor such that upper and lower surfaces of the extractor are in sliding contact with a lower and upper surfaces of the slot, respectively. A recess in the upper surface of the extractor is in communication with a recess in the lower surface of the extractor via a passage extending therebetween. One of the recesses is in communication with the ejection port and the other recess is in communication with the exterior of the slide to provide a passageway for the transport of propellant combustion products from the interior of the slide to the exterior of the slide.

19 Claims, 6 Drawing Sheets

CARTRIDGE EXTRACTOR

This is a continuation-in-part of copending application Ser. No. 08/536,009 filed on Sep. 29, 1995, now a Pat. No. 5,678,340 issue on Oct. 21, 1997.

BACKGROUND OF THE INVENTION

This invention relates in general to firearms and deals more particularly with an improved cartridge extractor for a firearm having a frame and a slide supported on the frame for reciprocal sliding movement relative to the frame between battery and retired positions.

The cartridge extractor of the present invention, which is carried by the slide, is particularly suitable for use in a semi-automatic breech locking pistol of the aforedescribed general type wherein the chamber end of the barrel moves downward to unlock the breech in response to an initial portion of the rearward movement of the slide and barrel from battery position.

In a firearm of the type with which the present invention is concerned, the extractor cooperates with an ejector, which is mounted in fixed position on the frame, during the ejection portion of the firearm slide cycle to eject a chambered live round of ammunition, when the slide is manually operated, or spent cartridge case, when the slide operates in the firing mode. In such a firearm the extractor is usually arranged to pivot to an ejecting position relative to the slide to release a chambered live round or spent cartridge case during the ejection portion of the operating cycle. However, this pivotal movement, essential to proper ejection, may cause problems during the cartridge extraction portion of the operating cycle. Specifically, if any unusual resistance to extraction is encountered the extractor may prematurely release the round or spent cartridge case allowing it to remain in a fully or partially chambered position within the firearm.

In conventional firearms of this type, it is not unusual for the hot combustion products from the ammunition propellant to stick to the surfaces of firearm components. Over time, the combustion products will accumulate on these surfaces. Such fouling of the extractor may cause problems during the cartridge extraction portion of the operating cycle. Specifically, the accumulated combustion products resist movement of the extractor and interfering with ejection of the spent cartridge case.

Several operating factors and handgun design parameters have a major impact on the operation of a cartridge extractor. The effect of such operating factors and design parameters is magnified for handguns that are small when compared to other handguns. For example, the physical dimensions and weight of the slide may render certain extractor designs inappropriate. Small handguns often have a narrow slide which defines a narrow cavity for receiving a spent cartridge. Since the extractor must hold on to the cartridge case long enough for it to be directed from the side of the handgun by the ejector, it must have a large range of movement to eject the cartridge from the narrow cavity. Consequently, ejectors that have a limited range of motion are not appropriate for handguns having a narrow slide.

The length of the barrel and the type of ammunition that is used, in combination with the weight of the slide, has an impact of the effectiveness of the extractor. Ignoring the effects of the recoil spring and friction forces, slide acceleration is equal to the applied recoil force divided by the mass of the slide (F=ma). Cartridges having a heavy load of propellant, such as "+P" ammunition, exert a higher gas pressure than cartridges having a normal load of propellant.

The higher gas pressure operating on the interior surface of the barrel creates a higher applied recoil force (F). A small handgun typically has a light slide (M) due to the reduced dimensions of the handgun. Therefore the slide experiences greater acceleration. Extractors designed for large handguns or rifles are not required to operate under such conditions and therefore will not reliably grip the cartridge when such a recoil force is applied.

In addition to creating an axial force, the propellant load creates a radial force that causes the cartridge case to expand radially outward into contact with the wall of the chamber. The higher the propellant load, the greater the radial force that is exerted and the tighter the engagement between the exterior surface of the cartridge case and the chamber wall. As combustion products accumulate on the chamber wall, the friction between the chamber wall and the cartridge case increases. After repeated firings, the extractor may not be able to overcome the combined effect of the residue-induced friction and the radial force exerted by ammunition having a heavy propellant load.

Extractors that are designed for use with a gun having a fixed barrel and a moving bolt or breech block may either be inappropriate for use or have only limited use with a breech locking gun.

SUMMARY OF THE INVENTION

It is an object of the invention to provide an improved cartridge extractor that provides for self-cleaning of accumulated propellant combustion products.

It is another object of the invention to provide a firearm having an slide and which includes an improved cartridge extractor that provides for the preferential accumulation of propellant combustion products on non-operating surfaces.

It is a further object of the invention to provide an improved cartridge extractor that transports propellant combustion products from the inside of the firearm to the outside of the firearm.

It is yet a further object of the invention to reduce the friction between the extractor and the slide, thereby reducing retardation of movement of the cartridge extractor.

These and related objects are achieved in accordance with the invention by providing a firearm having a frame, a slide supported on the frame for reciprocal sliding movement between battery and retired positions, a cartridge ejector mounted in fixed position on the frame, and a cartridge extractor carried by the slide. The extractor is supported within an extractor receiving recess in the slide. The extractor has a recess on each side and a passage providing communication between the two recesses. The first recess is in communication with the interior of the receiver and the second recess is open to the exterior of the firearm. Since the surfaces of these recesses are not in contact with the sides of the extractor receiving recess, propellant combustion products in the vicinity of the extractor will preferentially accumulate in the recesses. The accumulation of such combustion products causes displacement of the combustion products from the first recess through the passage to the second recess. Accumulated combustion products are scraped out of the second recess, and thereby out of the firearm, by relative pivotal movement between the extractor and the slide.

DETAILED DESCRIPTION OF PREFERRED EMBODIMENT

Figure 1:
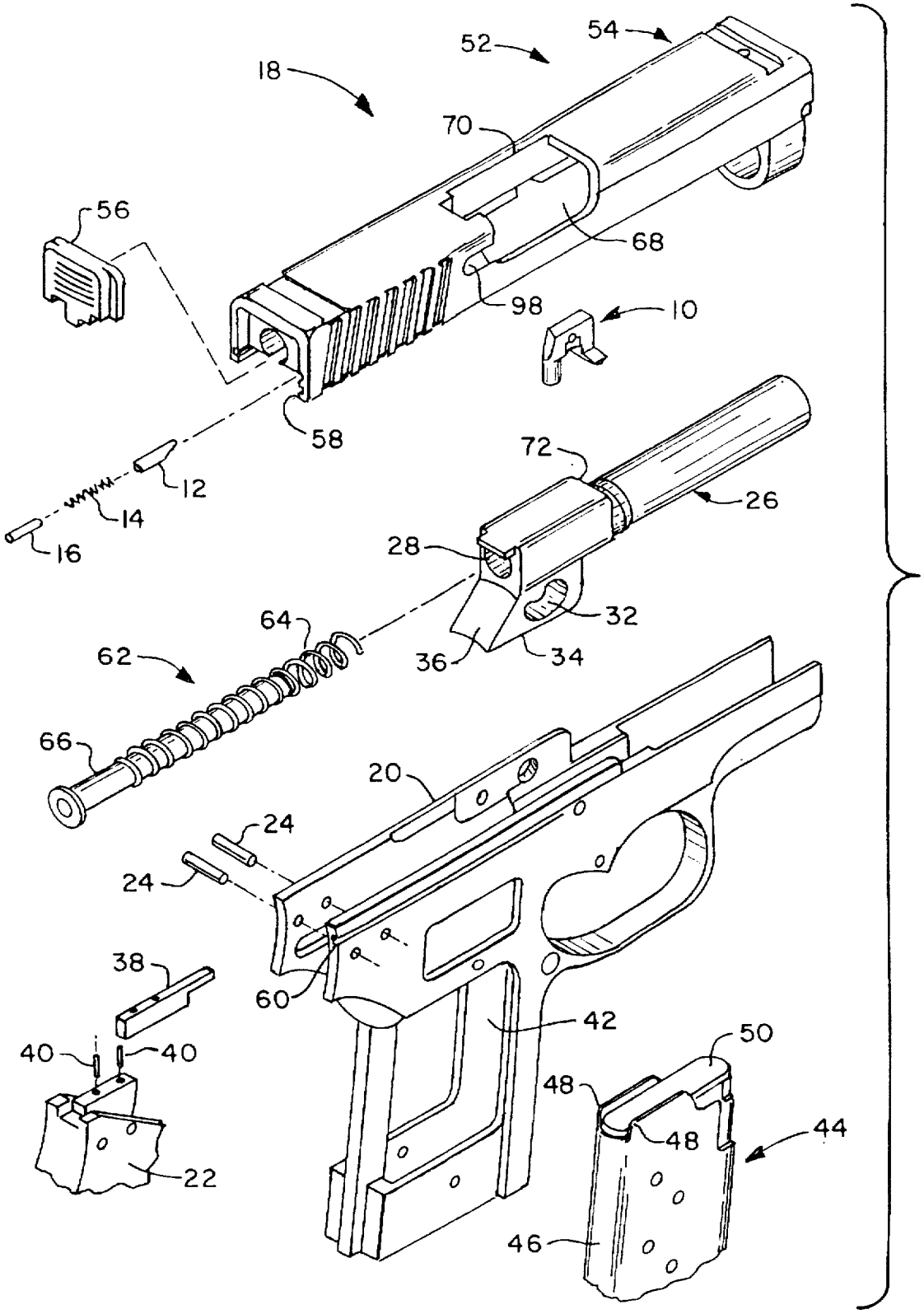
FIG. 1 is an exploded perspective view of a portion of a semiautomatic breech locking pistol having an extractor assembly embodying features of the present invention.

Referring now in greater detail to the drawings, FIG. 1 shows an exploded view of a portion of a semi-automatic firearm having an extractor embodying the present invention and indicated generally by the reference numeral 10. The extractor 10, an extractor front pin 12, an extractor spring 14 and an extractor rear pin 16 comprise an extractor assembly 18, all of which will be hereinafter further described. In Figure 1, for clarity of illustration, only those parts of the firearm which relate to the operation of the extractor assembly 18 are shown.

The firearm illustrated in FIG. 1 is a semi-automatic pistol having a breech locking action and includes a frame assembly which comprises a frame 20 and a frame back 22 secured in fixed position at the rear of the frame and between the sidewalls of the frame by pins 24. A barrel indicated generally at 26 has a chamber 28 and is secured to the frame 20 for limited movement relative to the frame by a slide stop pin (not shown) supported by the frame sidewalls and extending through a cam opening 32 formed in a barrel cam lug 34 which depends from the chamber end of the barrel 26. The barrel cam lug 34 also defines a rearwardly facing and forwardly and upwardly inclined ramp surface 36 which leads to the barrel chamber 28. An ejector, indicated at 38 and disposed within an upwardly open receiver defined by the frame assembly, is mounted in fixed position on the frame back 22 by dowel pins 40.

The frame assembly defines a magazine well 42 for receiving a conventional detachable box magazine indicated generally at 44. The magazine includes a magazine tube 46 having opposing feed lips 48 at its upper end and an upwardly biased magazine follower 50 for supporting a single column of cartridges (not shown) within the magazine tube in a conventional manner.

The extractor assembly 18 is carried by a longitudinally extending slide assembly, indicated generally at 52, which includes an slide designated generally by the numeral 54 and a slide back 56. A tongue 58 on the slide assembly 52 is supported by a groove 60 on the frame 20 for reciprocal longitudinal sliding movement between battery and retired positions in a manner well known in the firearm art. A recoil spring assembly indicated generally at 62, which includes a recoil spring 64 and a recoil spring guide 66, acts between the forward end of the slide 54 and a forwardly facing surface on the frame 20 (not shown) to bias the slide 54 in a forward direction and toward battery position.

Figure 2:
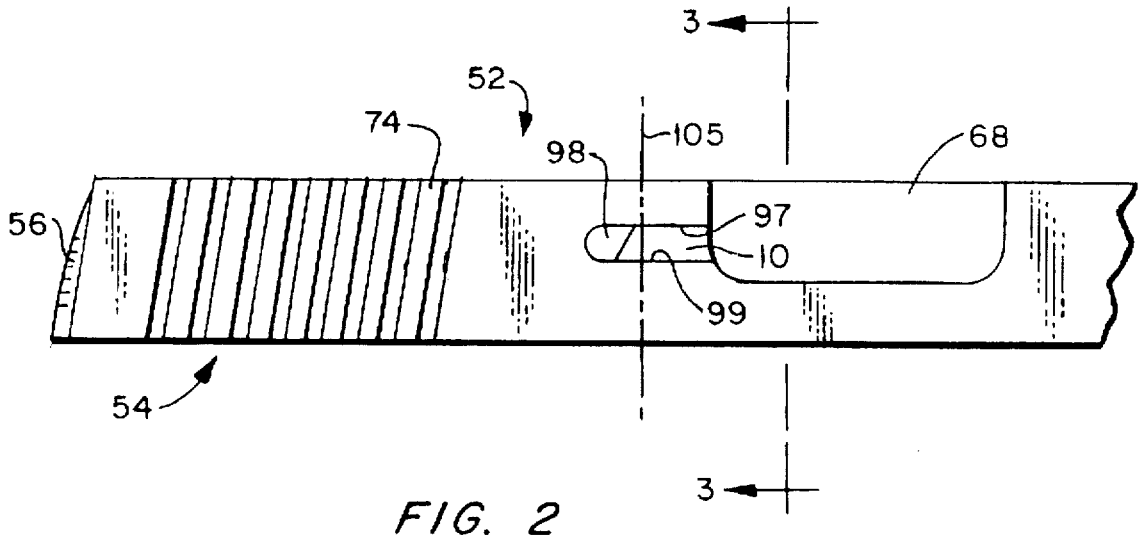
FIG. 2 is an enlarged side elevational view of the pistol slide assembly shown in FIG. 1.
Figure 3:
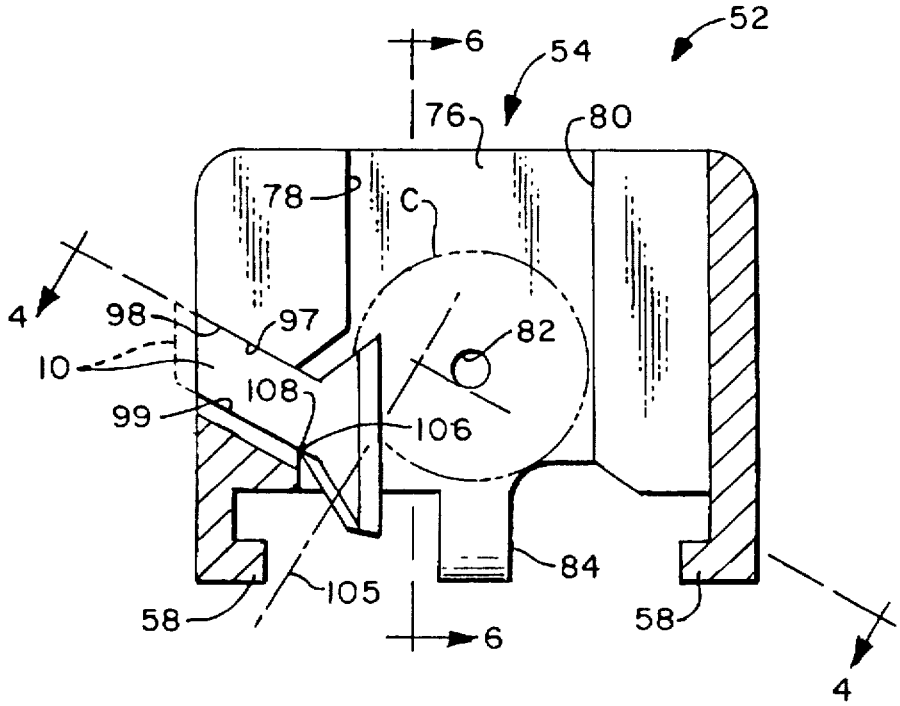
FIG. 3 is an enlarged sectional view through the slide assembly taken along the line 3—3 of FIG. 2.
Figure 6:
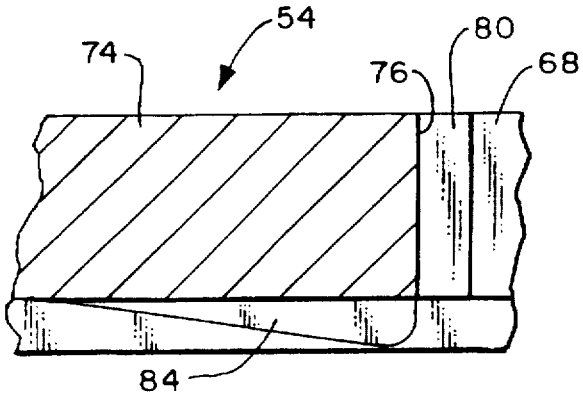
FIG. 6 is a reduced fragmentary sectional view through the slide assembly taken along line 6—6 of FIG. 3.
Figure 7:
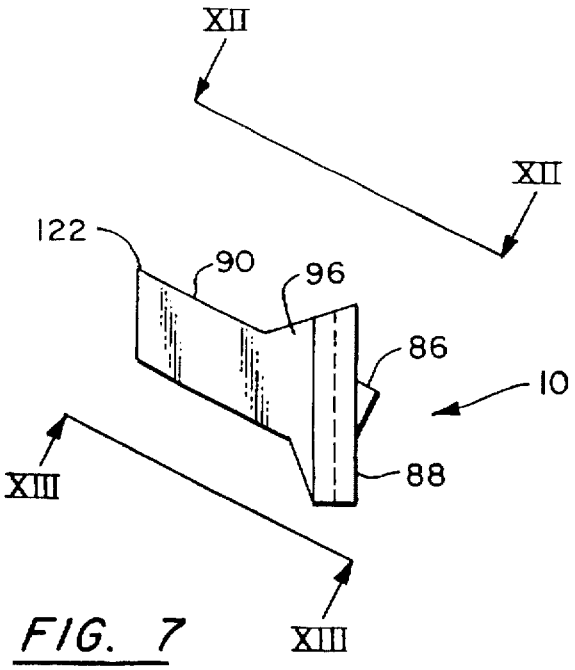
FIG. 7 is a front elevational view of the extractor as viewed from the front or muzzle end of the pistol.

Referring particularly to FIGS. 1–6, the slide assembly 52 and the manner in which the extractor assembly 18 is supported by the slide assembly 52 will now be considered in further detail. The slide 54 has a hollow downwardly open forward end portion for receiving the barrel 26 therein and defines an upwardly and laterally outwardly open ejection port indicated by the numeral 68. A rearwardly facing edge of the ejection port, indicated at 70, cooperates with a forwardly facing surface 72 on the barrel 26 to lock the slide in battery position. A rear portion of the slide 54 defines a breech bolt 74 which includes a forwardly facing breech surface 76 located at the rear of the ejection port 68. A pair of opposing laterally spaced apart and vertically disposed cartridge guide surfaces 78, 80 extend forwardly from opposite sides of the breech face 76. An aperture 82 (FIG. 3) opens through the breech face 76 midway between the cartridge guide surfaces 78, 80 for receiving a striker or firing pin (not shown). A forwardly and downwardly inclined longitudinally extending rib 84 depends from the breech bolt 74 centrally of the slide 54 and has a forwardly facing surface which forms a downward extension of the breech face 76 as shown in FIGS. 3 and 6.

Figure 8:
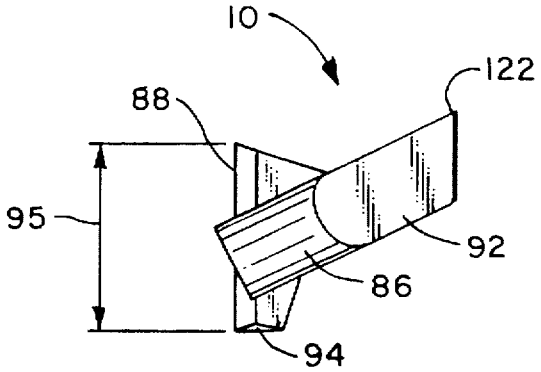
FIG. 8 is a rear elevational view of the extractor shown in FIG. 6.
Figure 9:
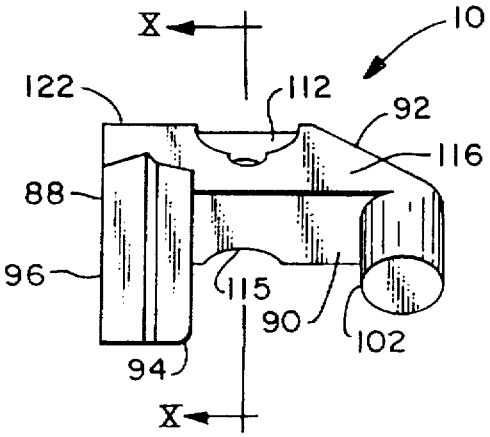
FIG. 9 is a right side elevational view of the extractor shown in FIG. 6.
Figure 10:
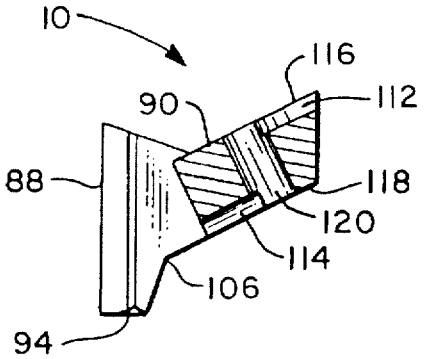
FIG. 10 is a sectional view taken along the line X—X of FIG. 9.
Figure 11:
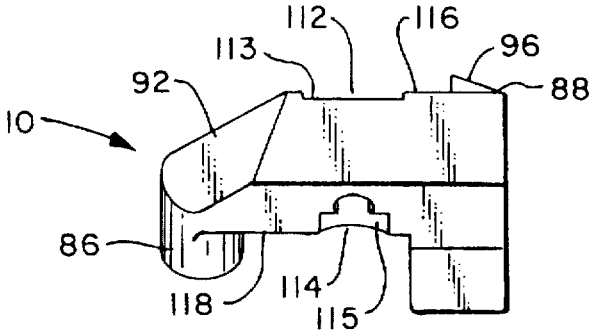
FIG. 11 is a left side elevational view of the extractor shown in FIG. 6.
Figure 12:
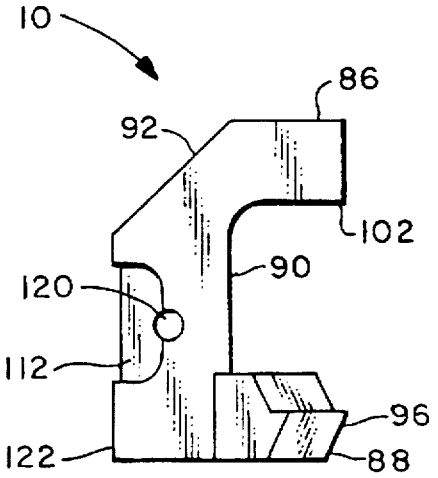
FIG. 12 is a top view of the extractor taken along the line XII—XII of FIG. 7.
Figure 13:
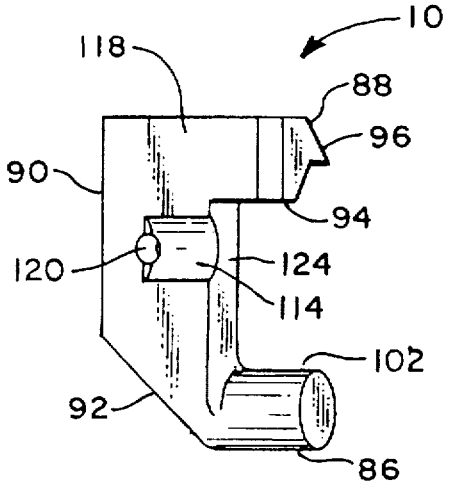
FIG. 13 is a bottom view of the extractor taken along the line XIII—XIII of FIG. 7.
Figure 14:
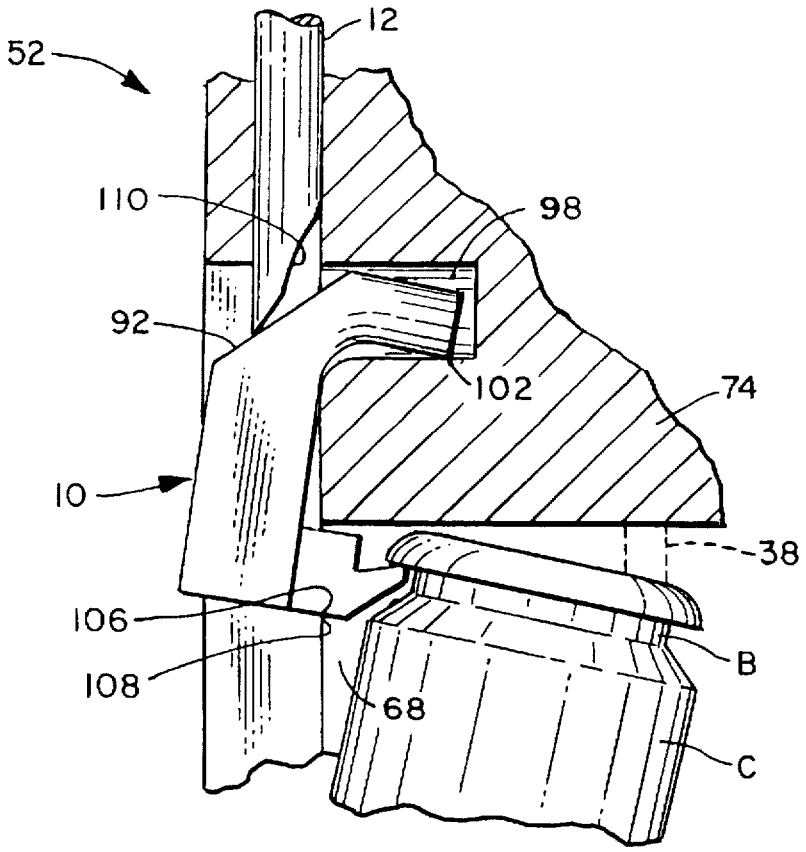
FIG. 14 is similar to FIG. 4 but shown with a cartridge in an ejecting position.

Considering now FIGS. 7–13, the extractor 10 comprises a unitary structure and has a generally cylindrical rear pin 86, and a claw 88 integrally connected by and extending inwardly from opposite breech and muzzle ends of a body portion indicated by the numeral 90. A cam surface 92 formed at the rear of the body portion 90 is forwardly and outwardly inclined from the outer end of the rear pin 86, substantially as shown in FIGS. 8 and 11. The claw 88 has an arcuately upwardly and inwardly curved lead surface 94 at its lower end and a forwardly facing and rearwardly and inwardly inclined cam surface 96 at its inner end. As shown in FIG. 8, the surface of the claw 88 is relatively long compared to that of conventional extractors. For example, the length 95 of the claw 88 is preferably 0.28 inches whereas the length of the claw of conventional extractors is generally 0.06 to 0.20 inches. The relatively long claw aids in maintaining engagement between the extractor 10 and the cartridge. The rear pin 86 and a part of the body portion 90 is received within a laterally inwardly and downwardly inclined extractor receiving recess 98 formed in the slide 54 and opening through breech face 76 and into the ejection port 68 and best shown in FIGS. 3–5.

The extractor 10 is received within the longitudinally extending extractor receiving recess or slot 98. The front and rear extractor pins 12, 16 and the extractor spring 14 are received within a longitudinally extending bore 100 (FIG. 1) formed in the breech bolt 74, opening through the rear of the slide 54, and communicating with the extractor receiving slot 98. The front and rear extractor pins 12, 16 and the extractor spring 14 are retained within the bore 100 by assembly of the slide back 56 with the slide 54. A forwardly facing pivot point 102 on the inner peripheral edge of the rear pin 86 engages a fulcrum 104 defined by a portion of the surface of the slot 98 to support the extractor 10 for pivotal movement in a clockwise direction from an inactive position, indicated by broken lines in FIG. 4, to an extracting position, shown in full lines. More specifically, the extractor 10 is supported within the recess 98 for upwardly and laterally outwardly pivotal movement from its inactive position to its extracting position about an upwardly and laterally inclined axis 105 passing through the fulcrum 104 and disposed within a plane generally normal to the longitudinal axis of the slide 54. The general position of the axis 105 relative to the slide 54 is shown in FIGS. 2 and 3. An abutment 106 on the extractor 10 cooperates with another abutment 108 on the slide 54 to limit clockwise pivotal movement of the extractor 10 from its inactive position to its extracting position of FIG. 4. The front extractor pin 12 has an arcuate cam surface 110 at its forward end for coengagement with the extractor cam surface 92 to bias the extractor 10 in a longitudinally forward direction and downwardly and laterally inwardly within the slot 98 and relative to the slide 54 and toward its inactive or broken line position of FIG. 4. Consequently, the force exerted by the extractor pin 12 holds the extractor 10 in place and in engagement with the cartridge, allowing the extractor 10 to be completely exposed on the sides.

U.S. Pat. No. 4,41 6,077 discloses a firearm including an extractor pin having a flat front end and an extractor having a flat rear surface. A spring biases the front end of the extractor pin into engagement with the rear surface of the extractor such that substantially all of the biasing force is parallel to the axis of the extractor pin and perpendicular to the surface of the extractor. As the extractor pivots to extract a spent cartridge, the relative contact area between the extractor and the extractor pin changes from a relatively large contact area, where substantially the entire front end of the extractor pin contacts the surface of the extractor, to a relatively small contact area, where only an edge portion of the extractor contacts the extractor pin. During this transition, the rear surface of the extractor must slide along the front end of the extractor pin resulting in large frictional forces that oppose such movement. The frictional forces can cause the extractor to malfunction, especially after combustion products have been deposited on the front end of the extractor pin and the rear surface of the extractor.

The cam surface 110 of the front extractor pin 12 engages the cam surface 92 of the extractor 10 on an angular line of contact at all times. Therefore, a large frictional force does not develop during relative movement between the front extractor pin 112 and the extractor 10. In addition, the angular line of contact causes the force applied to the extractor to have a component that is parallel to the axis of the front extractor pin 12 and a component that is perpendicular to the axis of the front extractor pin 12. Consequently, the front extractor pin 12 bias the extractor 10 in a longitudinally forward direction and downwardly and laterally inwardly within the slot 98 and relative to the slide 54 at all times.

When the barrel chamber 28 is empty and a magazine 44 containing one or more cartridges is disposed within the magazine well 42, drawing the slide 54 rearwardly from its battery to its retired position causes the rib 84 on the underside of the breech bolt 74 to travel rearwardly between the lips 48 at the upper end of the magazine tube 46 and along the length of the uppermost cartridge (not shown) contained within the magazine tube 46 thereby biasing the uppermost cartridge downwardly within the magazine 44. When the slide 54 reaches its fully retired position the uppermost cartridge in the magazine 44 is biased upwardly to a position wherein a portion of the rearwardly facing base surface of the cartridge is disposed immediately forward of the rib 84. Upon return movement of the slide 54 from its retired position toward its battery position the rib 84 strips the upper most cartridge from the magazine 44 and advances it toward the barrel chamber 28. The forward end of the forwardly advancing cartridge engages and travels up the ramp surface 36 defined by the barrel lug 34 as the slide 54 moves toward battery position. The chambered end of the barrel 26 simultaneously moves upwardly toward its breech locking or normal firing position as the forward end of the advancing cartridge enters the barrel chamber 28. When the base or rear end of the cartridge clears the forward ends of the magazine lips 48 the upwardly biased magazine follower 50 urges the base end of the advancing cartridge upwardly along the breech face 76 and into a position between the extractor claw 88 and the breech face 76.

Figure 4:
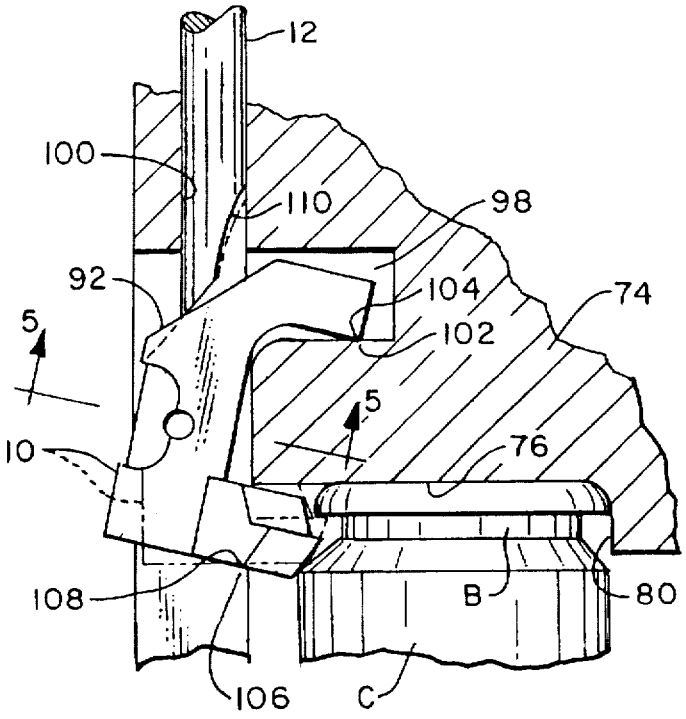
FIG. 4 is a fragmentary sectional view of the slide assembly taken generally along the line 4—4 of FIG. 3, with the extractor illustrated in extracting engagement with a cartridge.
Figure 5:
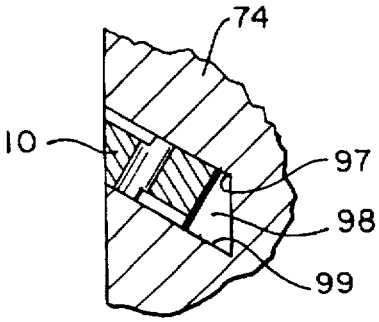
FIG. 5 is a fragmentary sectional view through the slide taken along the line 5—5 of FIG. 4.

Referring now to FIG. 4, as the cartridge, indicated by the letter C, moves upwardly along the frontal surface of the rib 84 the rim of the cartridge initially engages the radial surface 94 on the claw 88 urging the claw 88 in a clockwise pivotal direction about the pivot point 102 on the inner end of the rear pin 86 against the biasing force of the extractor front pin 12 and the extractor spring 14. As the cartridge moves upwardly along the breech face 76 in response to the biasing force of the magazine follower 50 the extractor 10 pivots to its extracting and ejecting position, indicated by full lines in FIG. 4, in which position an associated portion of the claw 88 is disposed within the cartridge extracting groove or cannelure, indicated by the letter B. The cartridge C attains the latter position as the extractor 10 reaches the substantial limit of its clockwise pivotal movement, such pivotal movement being limited by coengagement of the abutments 106, 108 on the extractor 10 and slide 54, respectively. The claw 88 remains positively secured in engagement with the cartridge rim within the cannelure B for as long as the cartridge remains in an extracting position with its base in engagement with the breech surface 76 and its longitudinal axis extending longitudinally of the slide 54. As the slide 54 approaches its battery position the forwardly moving cartridge attains a fully chambered position wherein the cartridge base is in the position C' indicated by broken lines in FIG. 3, the primer (not shown) is coaxially aligned with the firing pin or striker aperture 82 and the extractor claw 88 is in its extracting and ejecting position locked in engagement with the rim of the chambered cartridge and within the cannelure B of the cartridge.

When the firearm is discharged by operation of the firing mechanism (not shown) the slide 54, which is locked to the barrel 26 by the coengaging surfaces 70, 72, initially moves rearwardly with the barrel 26 in response to recoil providing a delay period during which the breech remains locked in closed position, the bullet leaves the barrel and the pressure within the barrel 26 and the chamber 28 are relieved. Further rearward movement of the slide 54 independently of the barrel 26 causes the extractor 10 to pull the spent cartridge out of the chamber 28. The rearwardly moving cartridge C, held in its extracting and ejecting position by the extractor 10, is moved downwardly across the face of the breech 76 by the downwardly moving chamber end of the barrel 26 thereby presenting the base surface of the cartridge to the ejector 38, which is mounted in fixed position at the opposite side of the frame from the extractor claw 88 carried by the slide 54. Thus, the extractor claw 88 is disposed in generally diametrically opposed relation to the ejector 38 relative to the cartridge base and engages a portion of the cartridge rim in generally diametrically opposed relation to the ejector. The cartridge is free to pivot a sufficient distance relative to the extractor to allow release of the cartridge rim from the extractor 10. Because of the relative positions of the extractor claw 88 and the ejector 38 the force of the ejector 38 against the base surface of the cartridge case causes the spent cartridge case to pivot about the extractor claw 88 and flip upwardly and outwardly through the ejection port 68. Thereafter, the extractor 10 is returned to its inactive position by the biasing force of the extractor front pin 12 and the extractor spring 14 whereupon the cycle is repeated and the next round of ammunition is stripped from the magazine 44 during return movement of the slide to battery position and loaded into the chamber 28 in preparation for the next firing cycle.

Figure 15:
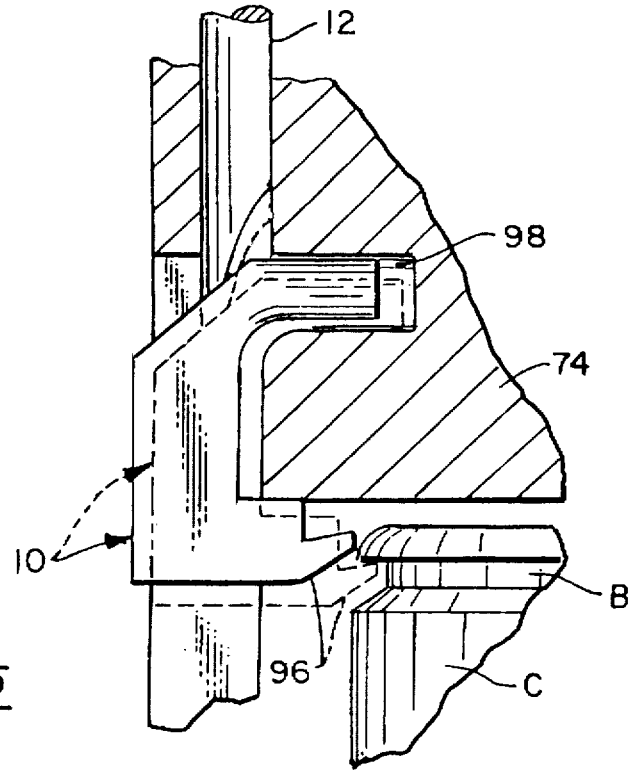
FIG. 15 is similar to FIG. 4 but shows the position of the extractor as the breech bolt portion of the slide closes on a chambered cartridge.

FIG. 15 illustrates the condition which occurs when the slide 54 is moved to the battery position, closing the breech on the chambered cartridge C. In this instance, the cam surface 96 on the forward end of the extracting claw 88 engages the rim of the chambered cartridge and cams the claw laterally outwardly against the biasing force exerted upon the cam surface 96 by the front extractor pin 12 and the extractor spring 14. This camming action causes the extractor 10 to move laterally upwardly and outwardly from its inactive or broken line position of FIG. 15 and toward its full line position of FIG. 15 and relative to the slide to ultimately allow the claw to snap over the cartridge rim and assume an extracting position within the cannelure of the cartridge C. Thereafter, when the slide 54 moves from its battery position to its retracted or retired position, the cartridge C will be withdrawn from the chamber. The extracting claw 88 will remain locked in positive engagement with the cartridge rim for as long as the cartridge case remains in the extracting position with its axis extending longitudinally of the slide, that is throughout the extracting portion of the operating cycle and until the cartridge is presented by the extractor 10 to the ejector 38 for ejection from the firearm.

With reference to FIGS. 7–13, the extractor 10 has top and bottom recesses 112, 114 in the body portion 90 on top and bottom surfaces 116, 118, thereof. A passage 120 extends from the first surface 116 of the extractor to the bottom surface 118 and intersects the top and bottom recesses 112, 114, providing communication between the top and bottom recesses 112, 114. The top recess 112 extends from the passage 120 to the outside edge 122 of the extractor 10 and from a point immediately adjacent cam surface 92 to the area where the body portion 90 is joined to extractor claw 88. The bottom recess 114 extends from the passage 120 to the inside edge 124 of the extractor 10 and from a point immediately adjacent the claw 88 for a distance substantially equal to the length of the top recess 112, wherein a portion of the bottom recess 114 extends beyond the breech face 76 when the extractor 10 is installed. Consequently, the top and bottom recesses 112, 114 and the passage 120 provide communications between the interior and the exterior of the firearm.

To facilitate the manufacturing process, the top and bottom recesses 112, 114 may be machined such that the surface 113 of the top recess 112 is flat and the surface 115 of the bottom recess 114 is arcuate, as shown in FIGS. 8 and 10. This allows machining of the recesses top and bottom 112, 114 with a single tool and without remounting the extractor 10 in the fixture. Alternatively, the surface 113 of the top recess 112 may be arcuate and the surface 115 of the bottom recess 114 may be flat. It should be appreciated that the surfaces 113, 115 of the top and bottom recesses 112, 114 may have the same shape without any effect on their function.

The top and bottom surfaces 116, 118 of the extractor 10 are in moveable contact with the sides 97, 99 of the extractor receiving slot 98 due to the pivoting action of the extractor 10. Since the surfaces 113, 115 of the top and bottom recesses 112, 114 are not in contact with the sides 97, 99 of the extractor receiving slot 98, the recesses top and bottom 112, 114 reduce the contact surface area between the sides of the extractor receiving slot 98 and the surfaces 116, 118 of the extractor 10, effectively reducing friction. Such reduction of friction helps prevent retardation of movement of the extractor 10.

The lack of contact between the surfaces of the top and bottom recesses 112, 114 and the sides 97, 99 of the extractor receiving slot 98 causes propellant combustion products in the vicinity of the extractor 10 to preferentially accumulate in the top and bottom recesses 112, 114. Contact between the surfaces 116, 118 of the extractor 10 and the sides 97, 99 of the extractor receiving slot 98 causes combustion products that are deposited on the surfaces 116, 118 to loosen and accumulate in the top and bottom recesses 112, 114. The combustion products that accumulate in the top and bottom recesses 112, 114 and the passage 120 cannot interfere with the operation of the extractor 10.

In addition to providing additional surface area for the preferential accumulation of combustion products, the top and bottom recesses 112, 114 and the passage 120 allow accumulated combustion products to be transported to the exterior of the firearm via the top recess 112, the passage 120 and the bottom recess 114. Since the combustion products accumulate as they pass from the interior of the firearm to the exterior of the firearm, the bottom recess 114 acts as the primary combustion product accumulator and the top recess 112 acts as a secondary combustion product accumulator. As the combustion products accumulate, the newest combustion products and the sliding contact between the extractor 10 and the extractor receiving slot 98 will cause the earlier combustion products to be pushed from the bottom recess 114, through the passage 120, to the top recess 112. Any combustion products that extend upwardly out of the top recess 112 are scraped out of the recess by the side 97 of the extractor receiving slot during pivotal movement of the extractor and are thereby removed from the interior of the firearm. Consequently, the amount of combustion products that are present reaches a stable level as the addition of new combustion products is offset by the discharge of old combustion products.

It should be appreciated that the top recess that extends to the exterior of the firearm and the bottom recess that extends to the interior of the firearm may be located in the opposite side of the extractor than that shown in the Figures. It should be further appreciated that size of the recesses and the passage may be increased or decreased from that shown in the Figures, so long as the mechanical strength of the extractor is not substantially affected. Tests have been conducted utilizing a firearm having an extractor 10 in accordance with the invention. Conventional extractors generally require thorough cleaning after firing 500 to 800 rounds of ammunition to prevent malfunction. A firearm having an extractor 10 in accordance with the invention fired 2,800 rounds without malfunction without cleaning of the extractor.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An anti-fouling extractor for extracting a cartridge from a firearm having at least one surface abutting the extractor, said surface having a tendency to accumulate combustion products upon operation of the firearm, the extractor movably engaging said surface during the extraction of the cartridge, the extractor comprising means adjacent said surface for receiving and briefly accumulating portions of the combustion products from said surface during moveable engagement by the extractor.

2. The anti-fouling extractor of claim 1 wherein said combustion product receiving means comprises a recess having an opening confronting the combustion product accumulating surface for receiving said combustion products during movement of said extractor.

3. The anti-fouling extractor of claim 1 wherein at least two combustion product receiving means are provided at spaced positions on said extractor.

4. The anti-fouling extractor of claim 3 including means for providing communication between said two combustion product receiving means to permit conveyance of said combustion product therebetween.

5. The anti-fouling extractor of claim 4 wherein said communication means comprises a passage interconnecting said two combustion product receiving means.

6. The anti-fouling extractor of claim 3 wherein at least one of said combustion product receiving means opens to the exterior of the firearm for discharging combustion product accumulated in said combustion product receiving means.

7. The anti-fouling extractor of claim 3 wherein said two combustion product receiving means are positioned on opposite sides of said extractor.

8. The anti-fouling extractor of claim 7 wherein said combustion product receiving means comprise recesses, each having an opening confronting a separate portion of the combustion product accumulating surface for receiving said combustion product during movement of said extractor.

9. The anti-fouling extractor of claim 8 wherein at least one of said recesses opens to the exterior of the firearm for discharging combustion product accumulated therein.

10. The anti-fouling extractor of claim 3 wherein one of said two combustion product receiving means comprises a recess having a planar accumulating surface and the other of said combustion product receiving means comprises a recess having an arcuate accumulating surface.

11. A firearm having a cartridge ejection mechanism comprising:

an ejection port for passage of a cartridge therethrough, an extractor mounting slot extending from said ejection port and defining a surface having a tendency to accumulate combustion products upon operation of the firearm and an anti-fouling cartridge extractor supported within said slot for movable engagement with said surface during extraction of the cartridge, said extractor having accumulator means adjacent said surface for receiving and accumulating portions of the combustion products from said surface during movement by the extractor and discharge means for discharging the combustion products from said accumulator means.

12. The firearm of claim 11 wherein the accumulator means is a recess having an opening confronting said surface, the ejector being mounted for pivotal movement within the slot whereby combustion products accumulated on said surface are removed from the surface and received in the recess during the pivotal movement of the ejector.

13. The firearm of claim 11 wherein said accumulator means comprises a recess having an opening confronting the surface of the slot for receiving said combustion products during movement of the extractor.

14. The firearm of claim 11 wherein at least two accumulator means are provided at spaced positions on the extractor.

15. The firearm of claim 14 wherein said ejection port further defines a breech face and wherein a portion of said one accumulator means extends beyond said breech face.

16. The firearm of claim 14 wherein said two accumulator means are positioned on opposite sides of said extractor.

17. The firearm of claim 14 wherein the firearm has a chamber wherein one of said accumulator means comprises a recess opening to the chamber and the other of said accumulator means comprises a recess opening to the exterior of the firearm.

18. The firearm of claim 14 wherein said extractor further comprises communication means for providing communication between said two accumulator means to permit conveyance of said combustion product therebetween.

19. The firearm of claim 18 wherein said communication means comprises a passage interconnecting said two accumulator means.

* * * * *